US010597748B2

(12) United States Patent
Teshima et al.

(10) Patent No.: US 10,597,748 B2
(45) Date of Patent: Mar. 24, 2020

(54) STEEL WIRE ROD FOR WIRE DRAWING

(71) Applicant: NIPPON STEEL & SUMITOMO METAL CORPORATION, Tokyo (JP)

(72) Inventors: Toshihiko Teshima, Tokyo (JP); Yoshihiro Daito, Tokyo (JP); Toshiyuki Manabe, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/769,026

(22) PCT Filed: Oct. 20, 2016

(86) PCT No.: PCT/JP2016/081137
§ 371 (c)(1),
(2) Date: Apr. 17, 2018

(87) PCT Pub. No.: WO2017/069207
PCT Pub. Date: Apr. 27, 2017

(65) Prior Publication Data

US 2018/0327889 A1 Nov. 15, 2018

(30) Foreign Application Priority Data

Oct. 23, 2015 (JP) ..... 2015-208935

(51) Int. Cl.
*C22C 38/02* (2006.01)
*C22C 38/18* (2006.01)
(Continued)

(52) U.S. Cl.
CPC ..... *C21D 9/52* (2013.01); *C21D 8/06* (2013.01); *C21D 8/065* (2013.01); *C21D 9/525* (2013.01);
(Continued)

(58) Field of Classification Search
CPC ..... C22C 38/02; C22C 38/18; C22C 38/32; C22C 38/00; C22C 38/001; C22C 38/04;
(Continued)

(56) References Cited

U.S. PATENT DOCUMENTS

2005/0087270 A1 4/2005 Nagao et al.
2017/0166992 A1* 6/2017 Hirakami ..... C22C 38/12

FOREIGN PATENT DOCUMENTS

CN 102301024 A 12/2011
EP 0 624 658 A1 11/1994
(Continued)

OTHER PUBLICATIONS

English language machine translation of JPH11315347 to Namimura et al. Generated Sep. 18, 2018. (Year: 2018).*
(Continued)

*Primary Examiner* — Brian D Walck
(74) *Attorney, Agent, or Firm* — Birch, Stewart, Kolasch & Birch, LLP

(57) ABSTRACT

Provided is a steel wire rod for wire drawing containing, in terms of % by mass, C: from 0.90 to 1.20%, Si: from 0.10 to 1.30%, Mn: from 0.20 to 1.00%, Cr: from 0.20 to 1.30%, Al: from 0.005 to 0.050%, and the balance being composed of Fe and impurities, wherein a content of each N, P, and S, which are contained as the impurities, is N: from 0.0070% or less, P: from 0.030% or less, S: from 0.010% or less, and the steel wire rod having a metallographic structure of which 95% or more by volume ratio is a lamellar pearlite structure, wherein the lamellar pearlite structure has an average lamellar spacing of from 50 to 75 nm, an average length of cementites in the lamellar pearlite structure is 1.0 to 4.0 μm, and a percentage of a number of cementites having a length of 0.5 μm or less among the cementites in the lamellar pearlite structure is 20% or less.

18 Claims, 2 Drawing Sheets

(51) Int. Cl.

| | |
|---|---|
| ***C22C 38/00*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C21D 8/06*** | (2006.01) |
| ***C21D 9/52*** | (2006.01) |

(52) U.S. Cl.
CPC ..... *C22C 38/00* (2013.01); *C22C 38/001* (2013.01); *C22C 38/02* (2013.01); *C22C 38/04* (2013.01); *C22C 38/06* (2013.01); *C22C 38/18* (2013.01); *C22C 38/22* (2013.01); *C22C 38/24* (2013.01); *C22C 38/26* (2013.01); *C22C 38/28* (2013.01); *C22C 38/32* (2013.01)

(58) Field of Classification Search
CPC ..... C22C 38/06; C22C 38/22; C22C 38/24; C22C 38/26; C22C 38/28; C21D 8/06; C21D 8/065; C21D 9/52; C21D 9/525
USPC ..... 148/320, 330
See application file for complete search history.

(56) References Cited

FOREIGN PATENT DOCUMENTS

| | | | |
|---|---|---|---|
| EP | 2 062 991 | A1 | 5/2009 |
| EP | 2 532 764 | A1 | 12/2012 |
| EP | 2 806 045 | A1 | 11/2014 |
| JP | 6-49592 | A | 2/1994 |
| JP | 11-315347 | A | 11/1999 |
| JP | 2001-234286 | A | 8/2001 |
| JP | 2005-126765 | A | 5/2005 |
| JP | 2005-232549 | A | 9/2005 |
| JP | 2008261028 | A | 10/2008 |
| JP | 2009-280836 | A | 12/2009 |
| JP | 2013-510234 | A | 3/2013 |
| JP | 5833485 | B2 | 12/2015 |
| KR | 10-2012-0070375 | A | 6/2012 |
| WO | WO 2009/084811 | A1 | 7/2009 |
| WO | WO 2011/055919 | A2 | 5/2011 |
| WO | WO 2011/089782 | A1 | 7/2011 |
| WO | WO 2015/119247 | A1 | 8/2015 |

OTHER PUBLICATIONS

English language machine translation of WO 2011089782 to Yamasaki et al. Generated Sep. 18, 2018. (Year: 2018).*

International Search Report for PCT/JP2016/081137 (PCT/ISA/210) dated Jan. 17, 2017.

Written Opinion of the International Searching Authority for PCT/JP2016/081137 (PCT/ISA/237) dated Jan. 17, 2017.

Extended European Search Report for Application No. 16857520.7, dated Apr. 16, 2019.

Chinese Office Action dated Apr. 28, 2019 in Chinese Patent Application No. 201680060011.6, with English translation.

Korean Office Action dated Jun. 25, 2019 for corresponding Korean Application No. 10-2018-7010778, with an English translation.

* cited by examiner

[Fig. 1]
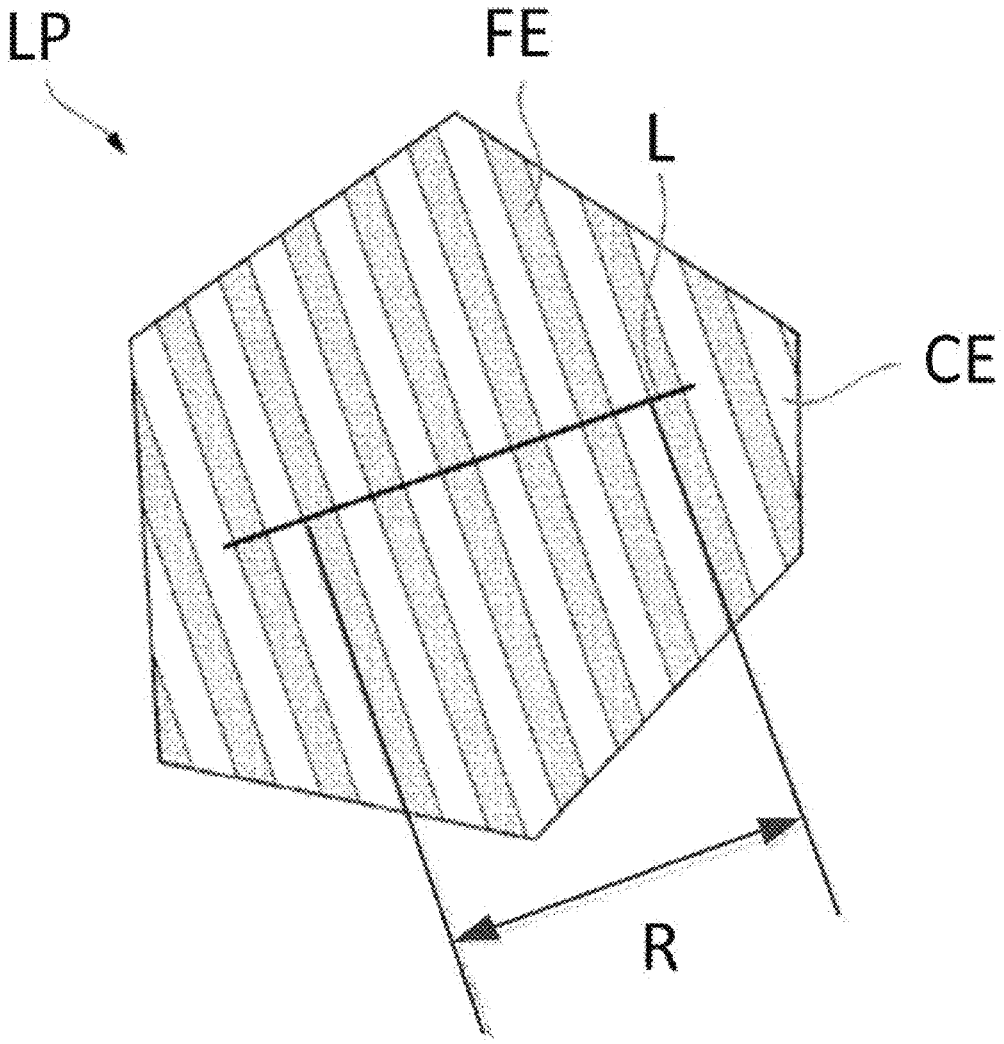

[Fig. 2]
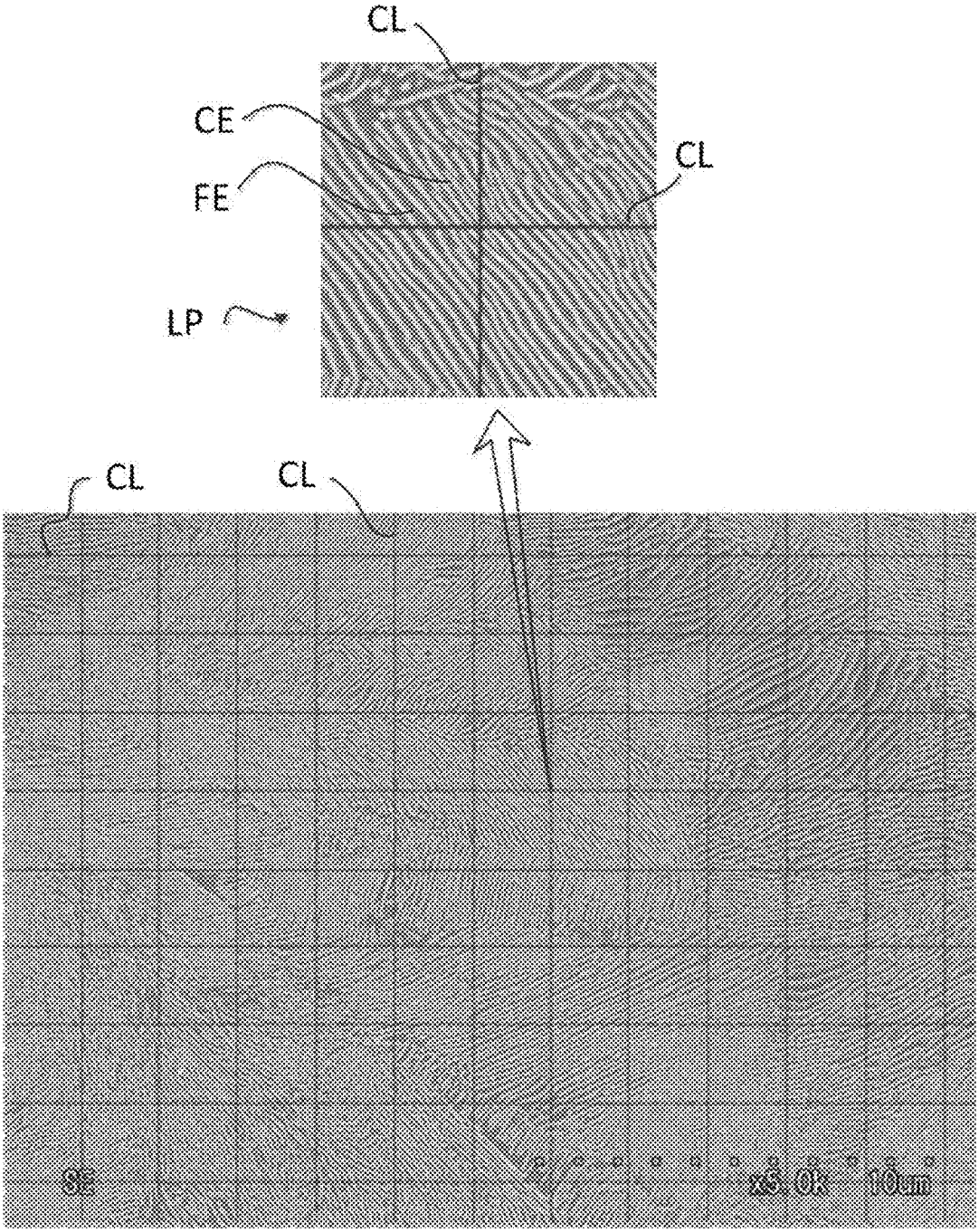

STEEL WIRE ROD FOR WIRE DRAWING

TECHNICAL FIELD

The present disclosure relates to a steel wire rod for wire drawing.

BACKGROUND ART

In order to meet demands for weight reduction and shortening of construction period, it is strongly desired to increase the strength of a variety of wire ropes such as power transmission cables and suspension bridge cables. As the strength of a wire rope increases, a demand for increasing the strength of a steel wire used as a material of the wire rope is increasing.

Steel wires are generally manufactured by subjecting a steel wire rod to a patenting process and then drawing the steel wire rod. A plurality of the thus obtained steel wires are twisted together by stranding to form a wire rope.

The largest problem in increasing the strength of a steel wire is to secure ductility and suppress a crack (delamination) occurring in the longitudinal direction of the steel wire at the time of twisting such as stranding.

Examples of conventional techniques for suppressing delamination include the techniques described in Patent Document 1 and Patent Document 2.

Patent Document 1 describes a PC steel wire which achieves both high strength and longitudinal crack (delamination) prevention by appropriately controlling the residual stress and yield ratio of the surface.

Patent Document 2 describes a technique of preventing sticking of N atoms to the dislocation in the structure of a steel wire as much as possible, improving the ductility of the steel wire, and preventing occurrence of delamination.

In addition, Patent Document 3 describes high-strength wire rod excellent in delayed fracture resistance which is composed of a steel containing C: 0.5 to 1.0% (meaning % by mass, the same applies hereinafter), in which the area ratio of the pearlite structure is 80% or more by suppressing the generation of one or more structures of pro-eutectoid ferrite, pro-eutectoid cementite, bainite, and martensite, and which has a strength of 1,200 $N/mm^2$ or more and excellent delayed fracture resistance by strong wire drawing.

Patent Document 4 describes a wire rod in which an area of 97% or more of the cross section perpendicular to the longitudinal direction of the wire rod is occupied by the pearlite structure, and an area of 0.5% or less of a central region of the cross section and an area of 0.5% or less of the first surface layer region of the cross section are occupied by a pro-eutectoid cementite structure.

Patent Document 5 describes a wire rod in which the main phase of the structure is pearlite, the AlN content is 0.005% or more, and in a maximum extreme value distribution of the diameter dGM of AlN represented by the geometric mean (ab) ½ of a length a and a thickness b, the percentage of AlN with a dGM of from 10 to 20 μm is 50% or more based on the number.

Patent Document 1: Japanese Patent Application Laid-Open (JP-A) No. 2005-232549

Patent Document 2: JP-A No. 2005-126765

Patent Document 3: JP-A No. H11-315347

Patent Document 4: WO2011/089782

Patent Document 5: Japanese Patent 5833485

SUMMARY OF THE INVENTION

Problems to be Solved by the Invention

However, a conventional steel wire having a high strength has insufficient twisting characteristics and can not sufficiently prevent occurrence of delamination at the time of twisting.

According to a conventional technique, in some cases, a steel wire rod breaks during a wire drawing, and wire drawing can not be stably performed.

One aspect of the disclosure has been made in view of the above circumstances, and an object of the disclosure is to provide a steel wire rod for wire drawing which can stably manufacture a steel wire having high strength and excellent twisting characteristics suitable as a material of a wire rope or the like while suppressing a wire break during drawing.

Means for Solving the Problems

In order to solve the above problem, the inventors of the present invention conducted investigations and studies on the influence of chemical composition and microstructure (metallographic structure) of a steel wire rod for wire drawing on a wire break during wire drawing and tensile strength and twisting characteristics of a steel wire obtained after wire drawing. The results were examined finely and analyzed to obtain the following findings (a) to (e).

(a) A steel wire of high strength can be obtained by sufficiently containing Cr, Si, and Mn in a steel wire rod for wire drawing. However, along with the increase in strength of a steel wire, delamination in a twisting test tends to occur.

(b) When the contents of Cr, Si, and Mn in a steel wire rod for wire drawing are increased, the length of a cementite in a lamellar pearlite structure of the steel wire rod for wire drawing tends to be short, and the number of cementites having a shape close to a granular shape with a length of 0.5 μm or less tends to increase. When the length of cementite in the lamellar pearlite structure of a steel wire rod for wire drawing is short and the number of cementites having a shape close to a granular shape with a length of 0.5 μm or less is large, delamination in a twisting test is likely to occur in steel wires obtained after wire drawing.

(c) However, even in cases where Cr, Si, and Mn are sufficiently contained in a steel wire rod for wire drawing, when the pearlite transformation temperature is slightly increased, the length of a cementite does not become too short, and the number of cementites having a shape close to a granular shape with a length of 0.5 μm or less does not increase too much. For this reason, a steel wire obtained after wire drawing is less likely to cause delamination in a twisting test.

(d) On the other hand, when the pearlite transformation temperature is raised, the lamellar spacing of the lamellar pearlite structure of a steel wire rod for wire drawing increases and the strength decreases.

Therefore, in order to realize a steel wire having high strength and excellent twisting characteristics, the pearlite transformation temperature needs to be adjusted within an appropriate range. The pearlite transformation temperature can be controlled by the lead bath temperature during a patenting process or the temperature of a fluidized bed furnace.

(e) Granulation of cementite progresses when a steel wire rod having undergone a pearlite transformation is kept at 550° C. or more, which is a temperature range where iron atoms can diffuse over a long distance. For this reason, the temperature of a steel wire rod which has undergone a pearlite transformation also needs to be controlled.

Based on the findings (a) to (e), the inventors conducted further detailed experiments and studies. As a result, it was found that the chemical composition of a steel wire rod for wire drawing, the volume ratio of the lamellar pearlite structure, the average lamellar spacing of the lamellar pearlite structure, the average length of cementites in the lamellar pearlite structure, and the percentage of the number of cementites having a length of 0.5 μm or less in the lamellar pearlite structure are each appropriately adjusted. It is then confirmed that, according to a steel wire rod for wire drawing in which these items are within an appropriate range, it is possible to solve the above-described problems and to stably manufacture a steel wire having high strength and excellent twisting characteristics suitable as a material for a wire rope or the like while suppressing a wire break during drawing, thereby arriving at the disclosure.

The summary of the disclosure is as follows.

(1) A steel wire rod for wire drawing containing, in terms of % by mass,

C: from 0.90 to 1.20%,

Si: from 0.10 to 1.30%,

Mn: from 0.20 to 1.00%,

Cr: from 0.20 to 1.30%,

Al: from 0.005 to 0.050%, and the balance being composed of Fe and impurities, wherein a content of each N, P, and S, which are contained as the impurities, is N: from 0.0070% or less, P: from 0.030% or less, and S: from 0.010% or less, and the steel wire rod having a metallographic structure of which 95% or more by volume ratio is a lamellar pearlite structure, wherein the lamellar pearlite structure has an average lamellar spacing of from 50 to 75 nm, an average length of cementites in the lamellar pearlite structure is 1.0 to 4.0 μm, and a percentage of a number of cementites having a length of 0.5 μm or less among the cementites in the lamellar pearlite structure is 20% or less.

(2) The steel wire rod for wire drawing according to (1), further containing, in terms of % by mass, Mo: from 0.02 to 0.20%.

(3) The steel wire rod for wire drawing according to (1) or (2), further containing, in terms of % by mass, one or more of V: from 0.02 to 0.15%, Ti: from 0.002 to 0.050%, and Nb: from 0.002 to 0.050%.

(4) The steel wire rod for wire drawing according to any one of (1) to (3), further containing, in terms of % by mass, B: from 0.0003 to 0.0030%.

(5) The steel wire rod for wire drawing according to (1), further containing, in terms of % by mass, one or more of Mo: from 0.02 to 0.20%, V: from 0.02 to 0.15%, Ti: from 0.002 to 0.050%, Nb: from 0.002 to 0.050%, and B: from 0.0003 to 0.0030%.

(6) The steel wire rod for wire drawing according to any one of (1) to (5), wherein a content of the Al is from 0.005 to 0.035% in terms of % by mass.

Effects of the Invention

According to the steel wire rod for wire drawing of one embodiment of the present disclosure, it is possible to stably manufacture a steel wire having high strength and excellent twisting characteristics suitable as material for wire ropes or the like by suppressing a wire break during wire drawing, which is extremely useful industrially.

BRIEF DESCRIPTION OF DRAWINGS

FIG. 1 is a diagram for explaining a method of measuring an average lamellar spacing of a lamellar pearlite structure.

FIG. 2 is a diagram for explaining a method of measuring an average length of cementites in a lamellar pearlite structure.

DESCRIPTION OF EMBODIMENTS

Hereinafter, an embodiment which is an example of the steel wire rod for wire drawing of the disclosure will be described in detail.

In the specification, a numerical range expressed by using "to" means a range including numerical values described before and after "to" as a lower limit value and an upper limit value.

The steel wire rod for wire drawing of the present embodiment is a steel wire rod for wire drawing by which a steel wire suitable as a material for a variety of wire ropes or the like such as power transmission cables or suspension bridge cables is obtained by wire drawing.

A steel wire used for material of a wire rope preferably has a tensile strength of 2300 MPa or more, more preferably 2400 MPa or more, and still more preferably 2500 MPa or more. A steel wire used for material of a wire rope preferably has a diameter of from 1.3 to 3.0 mm. It is preferable that a steel wire used for material of a wire rope does not generate delamination even once when 10 twisting tests to be described later are performed.

Next, the chemical composition and the microstructure (metallographic structure) of the steel wire rod for wire drawing of the embodiment (hereinafter, abbreviated as "steel wire material" in some cases) will be described in detail. "%" of the content of each element means "% by mass".

<Chemical Composition>

First, the chemical composition of the steel wire rod of the embodiment will be described.

The chemical composition of the steel wire rod of the embodiment is, in terms of % by mass, C: from 0.90 to 1.20%, Si: from 0.10 to 1.30%, Mn: from 0.20 to 1.00%, Cr: from 0.20 to 1.30%, Al: from 0.005 to 0.050%, and the balance being composed of Fe and impurities, wherein the content of each N, P, and S, which are contained as the impurities, is N: from 0.0070% or less, P: from 0.030% or less, and S: from 0.010% or less.

C: From 0.90 to 1.20%

C is an effective component for increasing the tensile strength of a steel wire rod. However, when the C content is less than 0.90%, the tensile strength is insufficient. For this reason, it is difficult to stably give a high strength of, for example, a tensile strength of 2300 MPa or more to a steel wire obtained by wire drawing a steel wire rod. In order to obtain a steel wire having a tensile strength of 2,400 MPa or more, it is desirable to set the C content of the steel wire rod to 1.00% or more. On the other hand, when the C content of a steel wire rod is too large, the steel wire rod becomes hard and the twisting characteristics of the steel wire obtained after wire drawing deteriorates. When the C content of the steel wire rod exceeds 1.20%, it is industrially difficult to suppress formation of pro-eutectoid cementite (cementite precipitated along a former austenite grain boundary). Therefore, the C content of a steel wire rod was set within the range of from 0.90 to 1.20%. The C content of a steel wire rod is desirably from 0.95% to 1.10%.

Si: From 0.10 to 1.30%

Si is an effective component for increasing the strength of a steel wire rod. Si is a necessary component also as a deoxidizing agent. However, when the Si content of a steel wire rod is less than 0.10%, an effect due to containing Si can not be sufficiently obtained. On the other hand, when the Si content of a steel wire rod exceeds 1.30%, the twisting characteristics of the steel wire obtained after wire drawing deteriorates. Therefore, the Si content of a steel wire rod is set within the range of from 0.10 to 1.30%. Si is an element which also affects the hardenability of steel materials and the generation of pro-eutectoid cementite. Accordingly, in order to stably obtain a steel wire rod having a desired microstructure, it is preferable to adjust the Si content of the steel wire rod within the range of from 0.10 to 1.00%, and more preferably within the range of from 0.20 to 0.50%.

Mn: From 0.20 to 1.00%

Mn increases the strength of a steel wire rod. Mn is a component having an action of fixing S in a steel as MnS and preventing hot embrittlement. However, when the Mn content of a steel wire rod is less than 0.20%, an effect of containing Mn can not be sufficiently obtained. On the other hand, Mn is an element which easily segregates. When Mn is contained in a steel wire rod in an amount exceeding 1.00%, Mn concentrates particularly in a central portion of the steel wire rod, martensite and bainite are generated in the central portion, and the wire drawing processability deteriorates. Therefore, the Mn content of a steel wire rod was set within the range of from 0.20 to 1.00%. Mn is an element which affects the hardenability of a steel and formation of pro-eutectoid cementite. Accordingly, in order to obtain a steel wire rod having a desired microstructure in a stable manner, it is desirable to adjust the Mn content of the steel wire rod within the range of from 0.30 to 0.50%.

Cr: From 0.20 to 1.30%

Cr has an effect of reducing the lamellar spacing of a lamellar pearlite structure of a steel wire rod and increasing the strength of the steel wire obtained after wire drawing. In order to stably obtain a steel wire having a tensile strength of 2300 MPa or more, a Cr content of 0.20% or more is needed. However, when the Cr content of a steel wire rod exceeds 1.30%, the wire drawing processability and the twisting characteristics of the steel wire obtained after wire drawing are deteriorated. Therefore, the Cr content of a steel wire rod was set within the range of from 0.20 to 1.30%. The Cr content is desirably from 0.30 to 0.80%.

Al: From 0.005 to 0.050%

Al is an element which has a deoxidizing action, and is necessary for reducing the amount of oxygen in a steel wire rod. However, when the Al content of a steel wire rod is less than 0.005%, it is difficult to obtain an effect by containing Al. On the other hand, Al is an element which is likely to form rigid oxide inclusions. When the Al content of a steel wire rod exceeds 0.050%, coarse oxide inclusions tend to be remarkably formed and the wire drawing processability becomes remarkable. Therefore, the content of Al in a steel wire rod is set to from 0.005 to 0.050%. A preferable lower limit of the Al content is 0.010%, and a more preferable lower limit thereof is 0.020%. A preferable upper limit of the Al content is 0.040%, a more preferable upper limit thereof is 0.035%, and a more preferable upper limit thereof is 0.030%.

The balance with respect to each of the above elements (C, Si, Mn, Cr, Al) is impurities and Fe. In the steel wire rod of the embodiment, the content of each N, P, and S, which are contained as impurities, is limited as follows.

The impurities mean components contained in a raw material or components mixed in a manufacturing process and not intentionally contained.

N: 0.0070% or less

N is an element which adheres to the dislocation during cold wire drawing and increases the strength of a steel wire rod, and on the contrary, decreases the wire drawing processability. When the N content of a steel wire rod exceeds 0.0070%, the wire drawing processability becomes remarkable. Therefore, the N content of a steel wire rod was limited to 0.0070% or less. A preferable upper limit of the N content is 0.0040%. The lower limit of the N content is 0.0000%. In other words, N does not have to be contained in a steel wire rod. However, from the viewpoint of the cost of removal of N and productivity, the lower limit of the N content is preferably set to 0.0010%.

P: 0.030% or Less

P is an element which segregates at a grain boundary of a steel wire rod and deteriorates the wire drawing processability. When the P content of a steel wire rod exceeds 0.030%, deterioration of the wire drawing processability becomes remarkable. Therefore, the P content of a steel wire rod is limited to 0.030% or less. The upper limit of the P content is preferably 0.025%. The lower limit of the P content is 0.000%. In other words, P does not have to be contained in a steel wire rod. However, from the viewpoint of cost of removal of P and productivity, the lower limit of the P content is preferably 0.001%.

S: 0.010% or Less

S is an element which reduces wire drawing processability. When the S content of a steel wire rod exceeds 0.010%, deterioration of the wire drawing processability becomes remarkable. Accordingly, the S content of a steel wire rod was limited to 0.010% or less. A preferable upper limit of the S content is 0.007%. The lower limit of the S content is 0.000%. In other words, S does not have to be contained in a steel wire rod. However, from the viewpoint of the cost of removing S and productivity, the lower limit of the S content is preferably 0.001%.

Further, in a steel wire rod of the embodiment, in addition to the above-described components, Mo: from 0.02 to 0.20% may be contained.

Mo: From 0.02 to 0.20%

The addition of Mo is optional. Mo exhibits an effect of improving a balance between the tensile strength and the twisting characteristics of a steel wire obtained by wire drawing of a steel wire rod. In order to obtain this effect, it is preferable to set the Mo content of a steel wire rod to 0.02% or more. From the viewpoint of obtaining a balance between the tensile strength and the twisting characteristics of a steel wire obtained after wire drawing, it is more preferable to set the Mo content of a steel wire rod to 0.04% or more. However, when the Mo content of a steel wire rod exceeds 0.20%, a martensitic structure tends to be formed, and the wire drawing processability may be deteriorated. Therefore, when Mo is positively added to a steel wire rod, the Mo content is preferably in the range of from 0.02 to 0.20%. More preferable Mo content is 0.10% or less.

Further, in the steel wire rod of the present embodiment, one or more of V: from 0.02 to 0.15%, Ti: from 0.002 to 0.05%, and Nb: from 0.002 to 0.05% may be contained in addition to the above-described components.

V: From 0.02 to 0.15%

The addition of V is optional. V forms carbides or carbonitrides in a steel wire rod to reduce the pearlite block size and to improve the wire drawing processability. In order to obtain this effect, it is preferable to set the V content of a steel wire rod to 0.02% or more. From the viewpoint of stably improving wire drawing processability, it is more preferable to set the V content of a steel wire rod to 0.05% or more. However, when the V content of a steel wire rod exceeds 0.15%, coarse carbides or carbonitrides tend to be formed and wire drawing processability may be deteriorated. Therefore, the V content of a steel wire rod is preferably from 0.02 to 0.15%. More preferable V content is 0.08% or less.

Ti: From 0.002 to 0.050%

The addition of Ti is optional. Ti forms carbides or carbonitrides in a steel wire rod to reduce the pearlite block size and to improve wire drawing processability. In order to obtain this effect, it is preferable to set the Ti content of a steel wire rod to 0.002% or more. From the viewpoint of stably improving wire drawing processability, it is more preferable to set the Ti content of a steel wire rod to 0.005% or more. However, when the Ti content of a steel wire rod exceeds 0.050%, coarse carbides or carbonitrides tend to be formed and wire drawing processability may be deteriorated. Therefore, it is preferable to set the Ti content of a steel wire rod to from 0.002 to 0.050%. A more preferable Ti content is from 0.010% to 0.030%.

Nb: from 0.002 to 0.050%

The addition of Nb is optional. Nb forms carbides or carbonitrides in a steel wire rod to reduce the pearlite block size and to improve wire drawing processability. In order to obtain this effect, it is preferable to set the Nb content of a steel wire rod to 0.002% or more. From the viewpoint of stably improving the wire drawing processability, it is more preferable to set the Nb content of a steel wire rod to 0.005% or more. However, when the Nb content of a steel wire rod exceeds 0.050%, coarse carbides or carbonitrides tend to be formed and the wire drawing processability may be deteriorated. Therefore, the Nb content of a steel wire rod is preferably from 0.002 to 0.050%. A more preferable Nb content is 0.020% or less.

Furthermore, in the steel wire rod of the embodiment, B: from 0.0003 to 0.0030% may be contained in addition to the above-described components.

B: From 0.0003 to 0.0030%

The addition of B is optional. B bonds with N dissolved in a steel wire rod to form BN, reduces solid solution N, and improves the wire drawing processability. In order to obtain this effect, it is preferable to set the B content of a steel wire rod to 0.0003% or more. From the viewpoint of stably improving the wire drawing processability, it is more preferable that the B content of a steel wire rod is 0.0007% or more. However, when the B content of a steel wire rod exceeds 0.0030%, coarse carbides tend to be formed, and the wire drawing processability may be deteriorated. Therefore, the B content of a steel wire rod is preferably from 0.0003 to 0.0030%. The more preferable B content is 0.0020% or less.

<Microstructure (Metallographic Structure)>

Next, the metallographic structure of a steel wire rod of the embodiment will be described.

The steel wire rod of the embodiment has a metallographic structure of which 95% or more by volume ratio is a lamellar pearlite structure (hereinafter, also simply referred to as "pearlite structure"), wherein the pearlite structure has an average lamellar spacing of from 50 to 75 nm, the average length of cementites in the pearlite structure is 1.0 to 4.0 μm, and the percentage of the number of cementites having a length of 0.5 μm or less among the cementites in the pearlite structure is 20% or less.

<Volume Ratio of Pearlite Structure>

A steel wire rod needs to have a metallographic structure whose pearlite structure is 95% or more in volume ratio. Since a steel wire rod having such a metallographic structure has a large work hardening ability and can be strengthened with a small processing amount by wire drawing, a steel wire having excellent twisting characteristics at a tensile strength of 2,300 MPa or more after drawing is obtained. When the volume ratio of the pearlite structure of a steel wire rod is 95% or more, an excellent wire drawing processability can be obtained. The volume ratio of the pearlite structure of a steel wire rod is preferably 98% or more. In the metallographic structure of a steel wire rod, the remaining structure except for the pearlite structure is one or more of cementite, ferrite, and bainite. In the steel wire rod of the embodiment, pseudo perlite having cementite in a shape close to granular is included in the pearlite structure.

<Average Lamellar Spacing of Pearlite Structure>

The pearlite structure of a steel wire rod needs to have an average lamellar spacing of from 50 to 75 nm. By having such a metallographic structure in the steel wire rod, a steel wire excellent in twisting characteristics with a tensile strength of 2,300 MPa or more after drawing is stably obtained. When the average lamellar spacing in the pearlite structure of a steel wire rod exceeds 75 nm, the tensile strength or twisting characteristics of the steel wire obtained after wire drawing may be insufficient. When the average lamellar spacing of the pearlite structure is less than 50 nm, the twisting characteristics of a steel wire obtained after wire drawing deteriorates, and occurrence of delamination in a twisting test can not be sufficiently suppressed in some cases. Therefore, the average lamellar spacing in the pearlite structure is set in the range of from 50 to 75 nm, preferably within the range of from 55 to 70 nm.

<Average Length of Cementite in Pearlite Structure>

The average length of cementites in the pearlite structure in a steel wire rod is from 1.0 to 4.0 μm. When the average length of cementites in the pearlite structure is less than 1.0 μm, even when other requirements are satisfied, the continuity of cementite in the pearlite structure becomes small, and therefore, a steel wire excellent in twisting characteristics after wire drawing can not be obtained. When the average length of cementites exceeds 4.0 μm, the wire drawing processability or the twisting characteristics of a steel wire rod is remarkably deteriorated. Therefore, the average length of cementites in the pearlite structure in a steel wire rod is set in the range of from 1.0 to 4.0 μm, and preferably from 1.2 to 3.0 μm.

<Percentage of the Number of Cementites Having Length of 0.5 μm or Less Among Cementites in Pearlite Structure>

In a steel wire rod, the percentage of the number of cementites having a length of 0.5 μm or less among the cementites in the pearlite structure is 20% or less. When the percentage of the number of cementites exceeds 20%, even when the other requirements are satisfied, the number of cementites in the pearlite structure which is close to granular increases, and therefore, a steel wire excellent in the twisting characteristics and tensile strength after wire drawing can not be obtained. Therefore, the percentage of the number of cementites having a length of 0.5 μm or less among the cementites in the pearlite structure is set to 20% or less, and preferably 15% or less. The lower limit of the percentage of the number of cementites is not particularly limited, and from the viewpoint of industrially stable production, it is desirable to set the percentage to 2% or more.

<Measurement Method of Metallographic Structure Condition>

Next, the measurement method of each condition of the metallographic structure specified in the steel wire rod of the embodiment will be described.

(Volume Ratio of Pearlite Structure)

A cross section (in other words, a cross section perpendicular to the length direction of a steel wire rod) of the steel wire rod is mirror polished, and then corroded by picral, and ten points at arbitrary positions are magnified 5,000 times using a field emission type scanning electron microscope (FE-SEM) and photographed. The area per field of view is $4.32\times10^{-4}$ $mm^2$ (length 18 μm, width 24 μm). Next, a transparent sheet (for example, an over head projector (OHP) sheet) is superimposed on each obtained photograph. In this state, color is applied to "a region overlapping with a non-pearlite structure other than a pearlite structure" in each transparent sheet. Next, the area ratio of the "area painted with color" in each transparent sheet is obtained from an image analysis software (a free software Image J ver.1.47s developed by the National Institute of Health (NIH)), and the average value thereof is calculated as the average value of the area ratio of the non-pearlite structure. Since the pearlite structure is an isotropic structure, the area ratio of the structure in the cross section of a steel wire rod is the same as the volume ratio of the structure of the steel wire rod. Therefore, the value obtained by subtracting the average value of the area ratio of the non-pearlite structure other than the pearlite structure from the whole (100%) is taken as the volume ratio of the pearlite structure.

(Average Lamellar Spacing of Pearlite Structure)

A cross section of the steel wire rod is mirror polished, and then corroded by picral, and ten points at arbitrary positions are magnified 10,000 times using a field emission type scanning electron microscope (FE-SEM) and photographed. The area per field of view is $1.08\times10^4$ $mm^2$ (length 9 μm, width 12 μm). Next, for each photograph obtained, a place where the lamellar spacing is the smallest and a place where the lamellar spacing is the second smallest, where lamellae of the pearlite structure are aligned and where measurement of five lamellar intervals can be performed are specified. Subsequently, a straight line is drawn perpendicularly to the extending direction of a lamella at a place where the lamellar spacing is the smallest and a place where the lamellar spacing is the second smallest in each picture, and the lamellar spacing on the straight line is measured for five lamellar intervals (see FIG. 1: where LP is a pearlite structure, FE is ferrite, CE is cementite, L is a straight line drawn perpendicular to the extending direction of a lamella, and R is the length of five lamellar intervals). Divide the numerical value of the lamellar interval of the obtained five lamellar interval by five to obtain lamellar intervals of the place with the smallest lamellar spacing and the place with the second smallest lamellar spacing. Next, the average value of the lamellar spacing at ten places in a steel wire rod thus obtained (two places per field of view (total of 20 places)) is calculated to be the average lamellar spacing of the pearlite structure of the steel wire rod.

(Average Length of Cementite in Pearlite Structure)

As illustrated in FIG. 2, a straight line is drawn at intervals of 2 μm along two orthogonal directions on each photograph used for measuring the area ratio of the non-pearlite structure. The length of cementite on the intersection of straight lines (cementite closest to the intersection in case there is no cementite on the intersection) is measured. The length of cementite is the length from one end to the other along the shape of cementite. At this time, when cementite is long and extends off the field of view of photograph, measurement is not considered and measurement is not performed. For each photograph, the lengths of more than 70 cementite are measured, and the average value of the lengths of cementite of the two photographs in the steel wire rod, in other words, the cementite length of two fields of view (at least 70 places per field of view, maximum 108 places (total from 140 to 216 places)) is calculated, which is defined as the average length of cementite in the pearlite structure of a steel wire rod. However, when the length of 70 or more cementite can not be measured, another field of view is measured.

In FIG. 2, LP represents a pearlite structure, FE represents ferrite, CE represents cementite, and CL represents a straight line drawn every 2 μm along two orthogonal directions.

(Percentage of the Number of Cementites Having Length of 0.5 Mm or Less Among Cementites in Pearlite Structure)

In a total of 140 to 216 points of cementites measured at the time of calculating the average length of the above-described cementite, the number of cementites having a length of 0.5 μm or less is obtained, and the percentage of cementites having a length of 0.5 μm or less is calculated to determine the percentage of the number of cementites having a length of 0.5 μm or less among cementites in the pearlite structure.

<Manufacturing Method>

Next, an example of the method of manufacturing a steel wire rod for wire drawing of the embodiment will be described. It is a matter of course that the method of manufacturing a steel wire rod of the embodiment is not limited to the method described below.

When the steel wire rod of the embodiment is manufactured, conditions in each manufacturing process are set according to a chemical composition, a target performance, a wire diameter, or the like in such a manner that each condition of the chemical composition and the microstructure (metallographic structure) can be surely satisfied.

As one example of the method of manufacturing a steel wire rod of the embodiment, a case in which a steel containing C: from 0.90 to 1.20%, Si: from 0.10 to 1.30%, Mn: from 0.20 to 1.00%, Cr: from 0.20 to 1.30%, Al: from 0.005% to 0.050%, and the balance being composed of Fe and impurities, and containing, as the impurities, N: from 0.0070% or less, P: from 0.030% or less, and S: from 0.010% or less is used will be described.

A steel piece having the above chemical composition is melted, a cast piece is produced by continuous casting, and the slab is subjected to blooming to obtain a steel piece.

A steel piece may be produced by the following method. A steel having the above chemical composition is melted, and an ingot is cast using a mold. Thereafter, the ingot may be hot forged to produce a steel piece. A hot forged material produced by hot forging an ingot may be cut, and an obtained cut material may be used as a steel piece.

Next, hot rolling of a steel piece is performed. In hot rolling of a steel piece, the steel piece is heated by using a general heating furnace and method, for example, in a nitrogen atmosphere or an argon atmosphere such that a central portion of the steel piece is 1,000 to 1,100° C., and a steel wire rod having a finish rolling temperature of from 900 to 1,000° C. and a diameter within the range of from 7.5 to 5.0 mm can be obtained. A steel wire rod obtained after the finish rolling is primarily cooled to from 700 to 750° C. at an average cooling rate of 50° C./s or more by combining water cooling and air cooling by the atmosphere.

Herein, the temperature of a steel piece in a heating furnace used for hot rolling refers to the surface temperature of a steel piece. The finish rolling temperature herein refers to the surface temperature of a steel wire rod immediately after finish rolling. The average cooling rate after finish rolling refers to the surface cooling rate of a steel wire rod after finish rolling.

Next, a steel wire rod primarily cooled to from 700 to 750° C. is immersed in a lead bath (patenting process, secondary cooling) in order to subject the steel wire to pearlite transformation. In the method of manufacturing a steel wire rod of the embodiment, the temperature of a lead bath in the patenting process (pearlite transformation temperature) is from 605 to 615° C., and the immersion time is from 30 to 70 seconds, which is slightly higher than the temperature of a lead bath in a conventional general patenting process. When the temperature of a lead bath is 605° C. or higher, the average length of cementite in the pearlite structure is shortened, and the number of cementite having a length of 0.5 μm or less is prevented from increasing. When the temperature of the lead bath is 615° C. or less, it is prevented that the lamellar spacing of the pearlite structure becomes too large. When the immersion time is 30 seconds or more, pearlite transformation is sufficiently completed. When the immersion time is within 70 seconds, a sharp increase in the number of cementites having a length of 0.5 μm or less can be suppressed. By setting the temperature of the lead bath to from 605 to 615° C. and the immersion time to 30 to 70 seconds, the lamellar spacing of the pearlite structure, the average length of cementites in the pearlite structure, and the percentage of the number of cementites having a length of 0.5 μm or less to predetermined ranges, and a pearlite-based metallic structure satisfying the above-described conditions can be obtained.

In the method of manufacturing a steel wire rod of the embodiment, the average cooling rate up to the temperature of a lead bath for a steel wire rod cooled to from 700 to 750° C. is not particularly limited, and is preferably from 25 to 60° C./s. When the cooling rate of a steel wire rod in a lead bath is 25° C./s or more, the volume ratio of the pearlite structure can be sufficiently secured. When the cooling rate of a steel wire rod in a lead bath is 60° C./s or less, the volume ratio of the pearlite structure can be sufficiently secured, and the average length of cementites in the pearlite structure and the percentage of the number of cementites having a length of 0.5 μm or less are within predetermined ranges, and a pearlite-based metallographic structure satisfying the above-described conditions can be surely obtained.

The steel wire rod cooled to from 700 to 750° C. 1) may be immersed in a lead bath immediately after cooling to from 700 to 750° C., or 2) may be immersed in a lead bath at a certain time (for example, after cooling) after cooling to from 700 to 750° C. In other words, the average cooling rate to the temperature of a lead bath of a steel wire rod cooled to from 700 to 750° C. is the average cooling rate from when the temperature of the steel wire rod reaches from 700 to 750° C. until when the temperature of the steel wire reaches the temperature of the lead bath.

In the method of manufacturing a steel wire rod of the embodiment, it is preferable to cool a steel wire rod taken out from a lead bath at from 605 to 615° C. to a temperature lower than 550° C., preferably to 500° C. at from 3° C./s to 10° C./s (tertiary cooling). When a steel wire rod having undergone pearlite transformation is held at 550° C. or higher, which is a temperature range where iron atoms can diffuse over a long distance, granulation of cementite proceeds. By cooling at 10° C./s or less, the average length of cementites in the pearlite structure in a steel wire rod becomes short, the percentage of the number of cementites having a length of 0.5 μm or less increases, and a structure satisfying the above conditions is attained. On the other hand, by cooling at less than 3° C./s, the percentage of the number of cementites having a length of 0.5 μm or less increases until it exceeds 20%, and therefore, cooling was performed at 3° C./s or more. As described above, when a steel wire rod taken out from a lead bath at from 605 to 615° C. is cooled to a temperature lower than 550° C. at 3° C./s to 10° C./s, a pearlite-based metallic structure satisfying the above-mentioned conditions can be more surely obtained. After tertiary cooling, the cooling rate to room temperature does not matter.

By performing the above process, a hot rolled wire rod of the embodiment is obtained.

According to the method of manufacturing a steel wire rod of the embodiment, a steel wire rod satisfying conditions of the above-described chemical composition and microstructure (metallographic structure) is obtained. It is a matter of course that the optimum patenting processing condition and other process conditions are different depending on the chemical composition of a steel wire rod, processing conditions up to a patenting process, the history of heat treatment, and the like.

The method of manufacturing a steel wire rod using patenting by a lead bath has been described as the method of manufacturing a steel wire rod of the embodiment, and the method of manufacturing a steel wire rod of the embodiment is not limited to this manufacturing method, and may be a method of manufacturing a steel wire rod using a patenting process (DLP) with a molten salt bath.

The steel wire rod of the embodiment has a predetermined chemical composition and has a metallographic structure of which 95% or more by volume ratio is a pearlite structure, wherein the pearlite structure has an average lamellar spacing of from 50 to 75 nm, the average length of cementites in the pearlite structure is 1.0 to 4.0 μm, and the percentage of the number of cementites having a length of 0.5 μm or less among the cementites in the pearlite structure is 20% or less.

Therefore, in the steel wire rod of the embodiment, it is possible to suppress a wire break during wire drawing, and a steel wire can be stably manufactured by wire drawing. Specifically, for example, even when wire drawing of 50 kg of the steel wire rod of the embodiment is performed to a diameter of 2.0 mm, the number of wire breaks can be suppressed to one or less, and wire breaks can be prevented sufficiently. By using the steel wire rod of the embodiment, it is possible to provide a steel wire rod having a high tensile strength of 2,300 MPa or more with a diameter of 1.3 to 3.0 mm, and a steel wire having excellent twisting characteristics which does not cause delamination even when 10 twisting tests to be described below are carried out is obtained. The thus obtained steel wire is suitable as a material for a wire rope or the like.

EXAMPLES

Next, Examples of the disclosure will be described. Conditions of Examples are examples adopted for confirming the feasibility and effect of the disclosure. The disclosure is not limited to such a condition example. The disclosure may adopt a variety of conditions without departing from the gist of the disclosure as long as an object of the disclosure is achieved.

50 kg of steels A to R having a chemical composition listed in Table 1 were melted in a vacuum melting furnace, and cast into ingots. A blank spot of each component amount in Table 1 means that the corresponding component is not contained or the content of the corresponding component is not more than levels considered as impurities.

Each of the above ingots was heated at 1,250° C. for 1 hour, hot forged to a diameter of 15 mm in such a manner that the finishing temperature was 950° C. or higher, and then allowed to cool to room temperature. The obtained hot forged material was cut to a diameter of 10 mm, and cut to obtain a cut material having a length of 1,000 mm.

TABLE 1

| | Chemical composition mass (%) Balance: Fe and impurities | | | | | | | | | | | | |
|---|---|---|---|---|---|---|---|---|---|---|---|---|---|
| | C | Si | Mn | P | S | Cr | Mo | V | Ti | Nb | Al | B | N |
| A | 0.92 | 0.52 | 0.42 | 0.011 | 0.008 | 0.52 | | | | | 0.029 | | 0.0031 |
| B | 1.08 | 0.25 | 0.49 | 0.012 | 0.008 | 0.36 | | | | | 0.031 | | 0.0029 |
| C | 0.97 | 0.42 | 0.39 | 0.011 | 0.007 | 0.75 | | | | | 0.030 | | 0.0030 |
| D | 0.93 | 0.50 | 0.45 | 0.011 | 0.008 | 0.49 | 0.07 | | | | 0.031 | | 0.0029 |
| E | 1.12 | 0.30 | 0.48 | 0.013 | 0.007 | 0.53 | 0.13 | | | | 0.031 | | 0.0030 |
| F | 0.97 | 0.30 | 0.48 | 0.013 | 0.007 | 0.53 | | 0.08 | | | 0.031 | | 0.0030 |
| G | 0.99 | 0.31 | 0.39 | 0.012 | 0.008 | 0.52 | | 0.11 | 0.050 | | 0.030 | | 0.0029 |
| H | 0.98 | 0.31 | 0.41 | 0.011 | 0.006 | 0.55 | | | | 0.014 | 0.033 | | 0.0042 |
| I | 0.99 | 0.29 | 0.39 | 0.022 | 0.008 | 0.54 | 0.08 | | 0.025 | | 0.029 | | 0.0036 |
| J | 1.01 | 0.31 | 0.41 | 0.011 | 0.008 | 0.46 | | | | 0.033 | 0.031 | | 0.0034 |
| K | 1.02 | 0.77 | 0.42 | 0.014 | 0.009 | 0.26 | | | 0.031 | | 0.028 | 0.0014 | 0.0039 |
| L | 1.02 | 0.78 | 0.41 | 0.016 | 0.008 | 0.26 | | | 0.024 | | 0.034 | 0.0021 | 0.0041 |
| M | 0.73 | 0.21 | 0.40 | 0.014 | 0.006 | 0.26 | | | | | 0.032 | | 0.0034 |
| N | 0.96 | 1.41 | 0.39 | 0.016 | 0.008 | 0.26 | | | | | 0.029 | | 0.0029 |
| O | 0.99 | 0.07 | 0.36 | 0.009 | 0.009 | 0.21 | | | | | 0.027 | | 0.0031 |
| P | 1.11 | 0.73 | 0.41 | 0.018 | 0.007 | 1.54 | | | | | 0.036 | | 0.0035 |
| Q | 0.99 | 0.21 | 0.40 | 0.014 | 0.006 | 0.05 | | | | | 0.032 | | 0.0034 |
| R | 0.92 | 0.34 | 0.39 | 0.016 | 0.008 | 0.55 | 0.26 | | | | 0.029 | | 0.0029 |

Cut materials having the chemical compositions listed in Table 1 were heat treated under heat treatment conditions a to p listed in Table 2 to obtain steel wire rods of Test Nos. 1 to 36 listed in Tables 3 to 4.

Specifically, when heat-treating the cut material with heat treatment conditions a to 1, p listed in Table 2, a steel wire rod was produced by the following method.

Each cut material was heated in a nitrogen atmosphere at a temperature of 1,050° C. for 15 minutes, hot rolled in such a manner that the center temperature was 1,000° C. or higher and the finish rolling temperature was within the range of from 950° C. to 1,000° C. to obtain a steel wire rod having a diameter of 6.2 mm. Thereafter, a steel wire rod having a temperature of 900° C. or higher was primarily cooled to 720° C. at an average cooling rate listed in Table 2 by combining water cooling and air cooling by the atmosphere. Then, the steel wire rod cooled to 720° C. was immersed in a lead bath at the bath temperature listed in Table 2 in the bath immersion time listed in Table 2, and subjected to secondary cooling from 720° C. to the bath temperature at the average cooling rate listed in Table 2. The average cooling rate of the secondary cooling was controlled by changing the lead bath temperature and the time from when the steel wire rod reached 720° C. until when the steel wire rod was immersed in the lead bath. Thereafter, the steel wire material was taken out of the lead bath, subjected to tertiary cooling from the bath temperature to 500° C. at the average cooling rate listed in Table 2, and then allowed to cool down to room temperature (30° C.) in the air to obtain a steel wire rod.

The average cooling temperature of a steel wire rod from hot rolling to 720° C., bath temperature, bath immersion time, average cooling rate of a steel wire rod from 720° C. to bath temperature after immersion in a lead bath, and average cooling temperature of a steel wire rod from the bath temperature to 500° C. are listed in Table 2.

When heat-treating a cut material with heat treatment conditions m to o listed in Table 2, a steel wire rod was produced by the following method.

Each cut material was heated in an argon atmosphere at a temperature of 1,050° C. for 15 minutes, hot rolled in such a manner that the center temperature was 1,000° C. or higher and the finish rolling temperature was within the range of from 950° C. to 1,000° C. to obtain a steel wire rod having a diameter of 6.2 mm. Thereafter, a steel wire rod having a temperature of 900° C. or higher was primarily cooled to 720° C. at an average cooling rate listed in Table 2 by combining water cooling and air cooling by the atmosphere. Then, the steel wire rod cooled to 720° C. was cooled to room temperature by cooling in the air or by air cooling with an electric fan without immersing the steel wire rod in a lead bath to obtain a steel wire rod. The average cooling rate of a steel wire rod from 720° C. to room temperature is listed in Table 2.

TABLE 2

| Heat treatment condition | From hot rolling to 720° C. Average cooling rate (° C./secs.) | Bath temperature (° C.) | Bath immersion time (secs.) | From 720° C. to bath temperature Average cooling rate (° C./secs.) | From bath temperature to 500° C. Average cooling rate (° C./secs.) | From 720° C. to room temperature Average cooling rate (° C./secs.) |
|---|---|---|---|---|---|---|
| a | 51 | 640 | 45 | 31 | 4 | — |
| b | 53 | 605 | 35 | 40 | 4 | — |
| c | 55 | 610 | 35 | 39 | 4 | — |
| d | 56 | 615 | 40 | 36 | 4 | — |
| e | 44 | 610 | 35 | 39 | 4 | — |
| f | 55 | 610 | 20 | 40 | 4 | — |
| g | 53 | 610 | 75 | 38 | 4 | — |
| h | 52 | 610 | 35 | 21 | 4 | — |
| i | 55 | 610 | 35 | 41 | 1 | — |
| j | 54 | 610 | 35 | 40 | 15 | — |
| k | 55 | 570 | 40 | 55 | 4 | — |
| l | 56 | 540 | 60 | 69 | 4 | — |

TABLE 2-continued

| Heat treatment condition | From hot rolling to 720° C. Average cooling rate (° C./secs.) | Bath temperature (° C.) | Bath immersion time (secs.) | From 720° C. to bath temperature Average cooling rate (° C./secs.) | From bath temperature to 500° C. Average cooling rate (° C./secs.) | From 720° C. to room temperature Average cooling rate (° C./secs.) |
|---|---|---|---|---|---|---|
| m | 53 | Cooling in the air | | — | — | 4 |
| n | 56 | Air cooling with electric fan | | — | — | 8 |
| o | 14 | Air cooling with electric fan | | — | — | 8 |
| p | 12 | 605 | 35 | 40 | 4 | — |

For the steel wire rods of Test Nos. 1 to 36 thus obtained, by using the method described above, the volume ratio of the pearlite structure, the average lamellar spacing of the pearlite structure, the average length of the cementite in the pearlite structure, and the percentage of the number of cementites having a length of 0.5 μm or less among the cementites in the pearlite structure were determined. The results are listed in Tables 3 to 4. Values outside the range specified in the disclosure are underlined.

TABLE 3

| Test No. | Chemical composition | Heat treatment condition | Pearlite Volume ratio (%) | Pearlite Average lamellar spacing (nm) | Cementite Average length (μm) | 0.5 μm or less Cementite percentage (%) | Number of wire breaks when wire drawing from diameter 6.2 → 2.0 mm (number of times/50 kg) | Tensile strength (MPa) | Twisting test Number of delamination occurrences (number of times) | |
|---|---|---|---|---|---|---|---|---|---|---|
| 1 | A | a | 98 | 79 | 3.60 | 16 | 0 | 2129 | 0 | Comparative Example |
| 2 | A | b | 99 | 67 | 1.34 | 15 | 0 | 2316 | 0 | Example |
| 3 | A | k | 100 | 59 | 0.93 | 18 | 1 | 2406 | 6 | Comparative Example |
| 4 | A | d | 99 | 56 | 1.46 | 16 | 0 | 2347 | 0 | Example |
| 5 | B | b | 98 | 55 | 1.32 | 16 | 0 | 2441 | 0 | Example |
| 6 | B | n | 92 | 112 | 3.69 | 18 | 3 | — | — | Comparative Example |
| 7 | C | d | 99 | 56 | 1.41 | 17 | 0 | 2463 | 0 | Example |
| 8 | C | l | 81 | 44 | 0.92 | 21 | 0 | 2374 | 3 | Comparative Example |
| 9 | D | b | 98 | 55 | 1.98 | 18 | 0 | 2361 | 0 | Example |
| 10 | E | p | 91 | 59 | 6.30 | 19 | 3 | — | — | Comparative Example |
| 11 | F | b | 99 | 57 | 1.18 | 16 | 0 | 2396 | 0 | Example |
| 12 | G | d | 99 | 61 | 1.23 | 16 | 0 | 2371 | 0 | Example |
| 13 | G | a | 99 | 81 | 3.41 | 19 | 1 | 2169 | 0 | Comparative Example |
| 14 | H | p | 93 | 66 | 5.60 | 14 | 3 | — | — | Comparative Example |
| 15 | H | d | 97 | 61 | 1.41 | 18 | 0 | 2377 | 0 | Example |
| 16 | I | l | 78 | 49 | 0.76 | 23 | 0 | 2416 | 4 | Comparative Example |
| 17 | I | b | 99 | 69 | 1.33 | 17 | 0 | 2321 | 0 | Example |
| 18 | J | m | 92 | 109 | 4.31 | 18 | 3 | — | — | Comparative Example |
| 19 | K | a | 99 | 81 | 2.93 | 16 | 0 | 2209 | 0 | Comparative Example |
| 20 | K | d | 99 | 71 | 1.55 | 15 | 0 | 2384 | 0 | Example |
| 21 | L | k | 100 | 51 | 0.91 | 23 | 0 | 2463 | 4 | Comparative Example |
| 22 | L | a | 100 | 91 | 3.21 | 13 | 0 | 1963 | 0 | Comparative Example |

TABLE 4

| Test No. | Chemical composition | Heat treatment condition | Pearlite Volume ratio (%) | Pearlite Average lamellar spacing (nm) | Cementite Average length (μm) | 0.5 μm or less Cementite percentage (%) | Number of wire breaks when wire drawing from diameter 6.2 → 2.0 mm (number of times/50 kg) | Tensile strength (MPa) | Twisting test Number of Delamination occurrences (number of times) | |
|---|---|---|---|---|---|---|---|---|---|---|
| 23 | M | b | 97 | 61 | 3.29 | 12 | 0 | 2196 | 0 | Comparative Example |
| 24 | N | b | 99 | 59 | 1.62 | 11 | 0 | 2411 | 5 | Comparative Example |

TABLE 4-continued

| Test No. | Chemical composition | Heat treatment condition | Pearlite Volume ratio (%) | Pearlite Average lamellar spacing (nm) | Cementite Average length (μm) | 0.5 μm or less Cementite percentage (%) | Number of wire breaks when wire drawing from diameter 6.2 → 2.0 mm (number of times/50 kg) | Tensile strength (MPa) | Twisting test Number of Delamination occurrences (number of times) | |
|---|---|---|---|---|---|---|---|---|---|---|
| 25 | O | d | 71 | 71 | 1.69 | 15 | 1 | 1958 | 5 | Comparative Example |
| 26 | P | b | 99 | 60 | 1.52 | 14 | 2 | 2513 | 7 | Comparative Example |
| 27 | Q | b | 99 | 63 | 1.63 | 17 | 0 | 2263 | 0 | Comparative Example |
| 28 | R | d | 26 | — | — | — | 3 | — | — | Comparative Example |
| 29 | A | c | 99 | 69 | 1.65 | 16 | 0 | 2302 | 0 | Example |
| 30 | A | e | 94 | 66 | 1.77 | 16 | 1 | 2311 | 3 | Comparative Example |
| 31 | A | f | 88 | 72 | 0.96 | 29 | 0 | 2289 | 4 | Comparative Example |
| 32 | A | g | 98 | 69 | 1.44 | 31 | 0 | 2277 | 1 | Comparative Example |
| 33 | A | h | 93 | 73 | 1.68 | 18 | 0 | 2301 | 3 | Comparative Example |
| 34 | A | i | 99 | 68 | 1.66 | 22 | 0 | 2291 | 3 | Comparative Example |
| 35 | A | j | 98 | 66 | 4.12 | 4 | 0 | 2313 | 1 | Comparative Example |
| 36 | A | o | 91 | 106 | 2.91 | 22 | 2 | 2308 | 4 | Comparative Example |

Next, a zinc phosphate coating film was formed on the surface of each steel wire rod by an ordinary method. Thereafter, each wire rod coated with the zinc phosphate coating was subjected to wire drawing to a diameter of 2.0 mm under a pass schedule in which the reduction in area at each die was 20% on average to obtain steel wires of Test Nos. 1 to 36.

For each steel wire rod, wire drawing processability in wire drawing for obtaining a steel wire was evaluated by the following method. The results are listed in Tables 3 to 4.

Drawing was performed on each 50 kg steel wire, and the number of wire breaks during wire drawing was recorded. When the number of wire breaks was 3 or more, wire drawing after the third wire break was discontinued. Then, when the number of wire breaks when drawing 50 kg of steel wire from a diameter of 6.2 mm to a diameter of 2.0 mm was 0, the wire drawing processability was evaluated as favorable, and when the number of wire breaks was 1 or more, the wire drawing processability was evaluated as poor.

For each steel wire obtained after wire drawing, the following tensile test and twisting test were conducted. The results are listed in Tables 3 to 4.

Three tensile tests in accordance with JIS Z 2241 (2011) were conducted for each steel wire, and the average value thereof was taken as the tensile strength.

A tensile strength of 2,300 MPa or more was evaluated as favorable.

In the twisting test, a steel wire having a length 100 times the wire diameter (diameter) was twisted until a wire break at 15 rpm, and whether or not delamination occurred was determined by a torque (torsional strength) curve. The determination on the torque curve was made by a method in which it was judged that delamination occurred when a torque once decreased before a wire break. The twisting test was conducted 10 times for each steel wire, and when no delamination occurred, it was evaluated that the twisting characteristics were favorable.

As listed in Tables 3 to 4, in Test Nos. 2, 4, 5, 7, 9, 11, 12, 15, 17, 20, and 29, the number of wire breaks was 0 and the wire drawing processability was favorable, the tensile strength was 2,300 MPa or more, and the number of delaminations was 0 and the twisting characteristics were favorable.

On the contrary, in Test Nos. 1, 13, 19, and 22 where the average lamellar spacing was wide, the tensile strength was less than 2,300 MPa.

In Test Nos. 3, 8, 16, and 21 in which the average length of cementites was short, delamination occurred a plurality of times, and the twisting characteristics were insufficient.

In Test Nos. 10, 14, 30, and 36 in which the steel wire rods of 900° C. or higher to 720° C. after hot rolling were gradually cooled at less than 50° C./s, since the volume ratio of the pearlite structure decreased due to precipitation of cementite, the number of wire breaks was large.

In Test No. 6 in which the steel wire rod was air-cooled from 720° C. to room temperature, the volume ratio of the pearlite structure was low, and therefore, the number of breaks was large.

In Test No. 18 in which the steel wire rod was allowed to cool from 720° C. to room temperature, the average length of cementites was long, and the number of wire breaks was large.

In Test No. 31 where the immersion time in the lead bath was short, pearlite transformation was not completed, and the average length of cementites was short.

In Test No. 32 with a long immersion time in a lead bath and Test No. 34 after taking out from a lead bath, the percentage of cementites of 0.5 μm or less increased after pearlite transformation.

In Test No. 33 in which the time from immersion in 720° C. to the lead bath temperature was lengthened, and the average cooling rate until the steel wire rod reached the lead bath temperature was delayed, non-pearlite structure increased and delamination occurred.

In Test No. 35 in which the steel wire rod was taken out from the lead bath and quenched, the cementite average length was long.

In Test No. 23 with a low C content and Test No. 27 with a low Cr content, the tensile strength was less than 2,300 MPa.

In Test No. 25 with a low Si content, the tensile strength was less than 2,300 MPa. In Test No. 25 with a low Si content, the volume ratio of the pearlite structure was low.

In Test No. 24 with large Si content, although the tensile strength was favorable, the twisting characteristics were insufficient.

In Test No. 26 with large Cr content, both the wire drawing processability and the twisting characteristics were insufficient.

In Test No. 28 with a high Mo content, pearlite transformation was not completed by immersion in a lead bath (patenting process), and the martensite structure was formed, and therefore, the number of breaks was large.

While preferred embodiments and examples of the present disclosure have been described above, these embodiments and examples are merely examples within the scope of the gist of the disclosure, and additions, omissions, substitutions, and other changes in the structure are possible without departing from the gist of the present disclosure. In other words, the disclosure is not limited by the above description, and is limited only by the description of the scope of the claims, and it goes without saying that it can be changed as appropriate within the scope of the claims.

The disclosure of Japanese Patent Application No. 2015-208935 is hereby incorporated by reference in its entirety.

All Documents, patent applications, and technical standards described herein are incorporated by reference herein to the same extent as if each of the Documents, patent applications, and technical standards had been specifically and individually indicated to be incorporated by reference.

The invention claimed is:

1. A steel wire rod for wire drawing, containing, in terms of % by mass,
C: from 0.90 to 1.20%,
Si: from 0.10 to 1.30%,
Mn: from 0.20 to 1.00%,
Cr: from 0.20 to 1.30%,
Al: from 0.005 to 0.050%,
Mo: from 0 to 0.20%,
V: from 0 to 0.15%,
Ti: from 0 to 0.050%,
Nb: from 0 to 0.050%,
B: from 0 to 0.0030%,
N: from 0 to 0.0070%,
P: from 0 to 0.030%,
S: from 0 to 0.010%, and
the balance comprising Fe and impurities, and
the steel wire rod having a metallographic structure of which 95% or more by volume ratio is a lamellar pearlite structure, wherein the lamellar pearlite structure has an average lamellar spacing of from 50 to 75 nm, an average length of cementites in the lamellar pearlite structure is 1.2 to 4.0 μm, and a percentage of a number of cementites having a length of 0.5 μm or less among the cementites in the lamellar pearlite structure is 20% or less.

2. The steel wire rod for wire drawing according to claim 1, containing, in terms of % by mass,
Mo: from 0.02 to 0.20%.

3. The steel wire rod for wire drawing according to claim 1 containing, in terms of % by mass, one or more of
V: from 0.02 to 0.15%,
Ti: from 0.002 to 0.050%, and
Nb: from 0.002 to 0.050%.

4. The steel wire rod for wire drawing according to claim 1, containing, in terms of % by mass,
B: from 0.0003 to 0.0030%.

5. The steel wire rod for wire drawing according to claim 1, containing, in terms of % by mass, one or more of
Mo: from 0.02 to 0.20%,
V: from 0.02 to 0.15%,
Ti: from 0.002 to 0.050%,
Nb: from 0.002 to 0.050%, and
B: from 0.0003 to 0.0030%.

6. The steel wire rod for wire drawing according to claim 1, wherein a content of the Al is from 0.005 to 0.035% in terms of % by mass.

7. The steel wire rod for wire drawing according to claim 2, containing, in terms of % by mass, one or more of
V: from 0.02 to 0.15%,
Ti: from 0.002 to 0.050%, and
Nb: from 0.002 to 0.050%.

8. The steel wire rod for wire drawing according to claim 2, containing, in terms of % by mass,
B: from 0.0003 to 0.0030%.

9. The steel wire rod for wire drawing according to claim 3, containing, in terms of % by mass,
B: from 0.0003 to 0.0030%.

10. The steel wire rod for wire drawing according to claim 7, containing, in terms of % by mass,
B: from 0.0003 to 0.0030%.

11. The steel wire rod for wire drawing according to claim 2, wherein a content of the Al is from 0.005 to 0.035% in terms of % by mass.

12. The steel wire rod for wire drawing according to claim 3, wherein a content of the Al is from 0.005 to 0.035% in terms of % by mass.

13. The steel wire rod for wire drawing according to claim 4, wherein a content of the Al is from 0.005 to 0.035% in terms of % by mass.

14. The steel wire rod for wire drawing according to claim 5, wherein a content of the Al is from 0.005 to 0.035% in terms of % by mass.

15. The steel wire rod for wire drawing according to claim 7, wherein a content of the Al is from 0.005 to 0.035% in terms of % by mass.

16. The steel wire rod for wire drawing according to claim 8, wherein a content of the Al is from 0.005 to 0.035% in terms of % by mass.

17. The steel wire rod for wire drawing according to claim 9, wherein a content of the Al is from 0.005 to 0.035% in terms of % by mass.

18. The steel wire rod for wire drawing according to claim 10, wherein a content of the Al is from 0.005 to 0.035% in terms of % by mass.

* * * * *